US005707720A

United States Patent [19]

Fox

[11] Patent Number: 5,707,720

[45] Date of Patent: Jan. 13, 1998

[54] METHODS AND MATERIALS FOR COATING TEXTILE COMPOSITIONS

[75] Inventor: Charles J. Fox, Mitchell, Ga.

[73] Assignee: Penford Products Co., Cedar Rapids, Iowa

[21] Appl. No.: 779,373

[22] Filed: Jan. 7, 1997

Related U.S. Application Data

[63] Continuation of Ser. No. 201,753, Feb. 24, 1994, abandoned, which is a continuation-in-part of Ser. No. 22,726, Feb. 24, 1993, abandoned.

[51] Int. Cl.[6] ..... C08L 25/10; C08L 3/02

[52] U.S. Cl. ..... 428/245; 428/261; 428/290; 428/291; 106/210; 106/212; 8/115.6

[58] Field of Search ..... 106/210, 212; 8/115.6; 428/245, 261, 290, 291

[56] References Cited

U.S. PATENT DOCUMENTS

| | | | |
|---|---|---|---|
| 4,248,755 | 2/1981 | Williams | 260/29.6 TA |
| 4,301,017 | 11/1981 | Kightlinger et al. | 252/8.6 |
| 4,375,535 | 3/1983 | Kightlinger et al. | 527/313 |
| 4,421,566 | 12/1983 | Hasuly et al. | 106/213 |
| 4,530,876 | 7/1985 | Brodmann et al. | 428/283 |
| 4,786,530 | 11/1988 | Fox | 427/384 |
| 4,808,479 | 2/1989 | Fox | 428/394 |
| 5,003,022 | 3/1991 | Nguyen et al. | 527/300 |
| 5,130,394 | 7/1992 | Nguyen et al. | 527/300 |

FOREIGN PATENT DOCUMENTS

WO 92/13714 8/1992 WIPO .

OTHER PUBLICATIONS

*Chemistry and Industry of Starch*, Kerr, Ralph W., Editor, Academic Press Inc. Publishers, New York, New York, 1950, pp. 570–575.

*Primary Examiner*—W. Robinson H. Clark

*Attorney, Agent, or Firm*—Marshall, O'Toole, Gerstein, Murray & Borun

[57] ABSTRACT

The present invention provides a method of preparing a sized warp yarn comprising the steps of (a) preparing a warp yarn sizing composition comprising (i) a first component which is a starch material, and (ii) a second component comprising starch and a reaction product of styrene and 1,3-butadiene wherein said starch component of said second component is characterized by an intrinsic viscosity of from about 0.07 to about 0.35 dl/g, and (b) slashing warp yarn with the sizing composition of step (a).

18 Claims, No Drawings

METHODS AND MATERIALS FOR COATING TEXTILE COMPOSITIONS

This is a continuation of U.S. application Ser. No. 08/201,753, filed Feb. 24, 1994, now abandoned, which is a continuation-in-part application of U.S. patent application Ser. No. 08/022,726 filed Feb. 24, 1993, now abandoned.

BACKGROUND OF THE INVENTION

The present invention relates to warp yarn sizing compositions utilized in the manufacturing process for textiles and more particularly to improved adhesion for such warp yarn sizing compositions. Specifically, the invention relates to an improved warp yarn sizing composition for use in the manufacture of fabric, comprising (i) a first component which is a starch material and (ii) a second component which comprises starch and a reaction product of styrene and 1,3-butadiene wherein said starch component of said second component is characterized by an intrinsic viscosity of from about 0.07 dl/g to about 0.35 dl/g. The invention further provides preferred yarn sizing compositions which can be produced, shipped and stored in a sold free-flowing ready to use form long-term stability and which need not be produced immediately prior to use.

In the course of manufacturing textiles, fiber materials are woven together to form a cloth. In the weaving operation, feed yarn, referred to as warp yarn, is fed into a loom. A weaving yarn, referred to as a filling yarn, is woven in between the individual warp yarns to form a fabric. During this operation, there is considerable abrasion between the warp yarn and filling yarn such as during the shed opening and weaving steps which sometimes results in breakage and an inefficient weaving operation. To reduce abrasion between the warp yarn and the filling yarn, the warp yarn is sized with a warp yarn sizing composition. Many warp sizing materials are used in the manufacture of textile fabrics. Heretofore, the main property sought to be controlled by sizing warp yarn was the reduction of abrasion between the warp yarn and the filling yarn during the weaving operation. While other properties imparted to the fabric by use of a sized warp yarn such as stiffness and strength are pertinent, the primary property that the sized warp yarn must possess is the ability to resist abrasion.

Warp yarn size systems generally comprise water; (i) a basic size material which is typically a modified and/or derivatized starch and/or polyvinyl alcohol; (ii) binders; and (iii) optional additional ingredients including lubricants such as waxes and the like and other additives including but not limited to surfactants, defoamers, salts and thickeners. Typical binders used in warp yarn size systems include polyester resins, vinyl acetate, vinyl acetate copolymers, acrylic resins, polyvinyl alcohol and polyvinyl acetate. In some cases polyvinyl alcohol alone has been utilized as a warp yarn sizing composition but it is relatively expensive and its use in large quantities may be subject to environmental concerns.

The binders and other elements of the warp yarn size systems function to control the adhesion of the base size materials to the yarn and control size film strength, sized yarn moisture content, migration of size on the fibers (encapsulation), or through the fibers (penetration), as well as the size handling properties during application. Adhesion of the size to the yarns is important as it reduces shedding of size and fiber during weaving. Reduction of shedding is not only important from the standpoint of industrial hygiene but also because shedding of the yarn size leaves the yarn unprotected and defeats the purpose of sizing. There also exists a desire in the art for warp yarn sizing materials characterized by suitable desize properties such that the sizes may be readily removed by washing after the weaving operation.

Accordingly, there exists a need in the art for a relatively inexpensive warp yarn sizing composition having improved encapsulation and penetration properties that provides good abrasion protection, resists shedding, and may be readily desized after the weaving operation.

SUMMARY OF THE INVENTION

The present invention relates to improved warp yarn sizing compositions and methods for sizing warp yarns. Specifically, the invention provides improved warp yarn sizing compositions comprising (i) a first component which is a starch material and (ii) a second component which comprises starch and a reaction product of styrene and 1,3-butadiene wherein the starch component of the second component is characterized by an intrinsic viscosity between about 0.07 and about 0.35 dg/l when measured under standard conditions in water at 25° C. (room temperature).

The invention further provides methods of preparing a sized warp yarn comprising the steps of: (a) preparing a warp yarn sizing composition comprising (i) a first component which is a starch material (corresponding to a basic size), and (ii) a second component (corresponding to a binder) comprising starch and a reaction product of styrene and 1,3-butadiene and wherein said starch component of said second component is characterized by an intrinsic viscosity of from about 0.07 dl/g and about 0.35 dl/g; and (b) slashing warp yarn with the sizing composition of step (a). The invention further provides a sized warp yarn prepared using the warp yarn sizing compositions of the invention as well as sized cloth comprising a sized warp yarn prepared using the warp yarn sizing composition of the invention.

According to one preferred embodiment of the invention an improved warp yarn sizing composition is provided which may be prepared and stored in a dry ready to use form and is characterized by having long-term stability which need not be mixed immediately prior to use. The preferred size composition comprises (i) approximately 90–96% by weight uncooked acid modified starch as a first component and (ii) a second component comprising approximately 4–10% by weight a binder comprising starch and a reaction product of styrene and 1,3-butadiene and wherein said starch is characterized by an intrinsic viscosity of from about 0.07 dl/g and about 0.35 dl/g.

DETAILED DESCRIPTION OF THE INVENTION

The warp yarn sizing compositions of the present invention provide improvements in warp yarn size coating which translate to improved yarn protection and which reduce shedding and improve yield during weaving. Specifically, the warp yarn sizes of the invention exhibit reduced migration and improved yarn encapsulation and penetration. Because of these improvements in film formation and penetration there is reduced size and fiber shedding during busting at the slasher and weaving of the sized yarn at the loom.

Encapsulation refers to the amount of size on the surface of the yarn. While conventional yarn sizes typically encapsulate about 270° of a yarn surface, the yarn size compositions of the invention encapsulate as much as 360° of the yarn surface. The yarn size compositions of the invention also exhibit improved yarn penetration over conventional yarn size compositions. The improvements in encapsulation and penetration can be observed microscopically but can also be determined by other methods known to those of skill in the textile coating art such as by viewing the coated yarn while holding it up to the right. Yarn sized according to the present methods has improved fiber lay and provides a lessened tendency to "knit" or tangle which can interfere with weaving.

The improved warp yarn compositions of the invention also exhibit excellent desize properties. Such desize properties are surprising in light of the presence of hydrophobic styrene/butadiene reaction product as a component of the sizing compositions. The presence of such styrene/butadiene components would be expected to resist water solubilization and impart poor desize characteristics to the sized fabrics. Nevertheless, the desize characteristics of the size compositions of the invention are generally comparable to those of conventional sizes lacking such hydrophobic components.

The improved warp yarn sizing compositions of the invention comprise a first component which is a starch material and which corresponds generally to a basic size of conventional size composition. Starches which are useful as the first component of the present invention include modified and unmodified starches including hydroxyalkyl ether modified starches, carboxyalkyl starches, acid modified and oxidized starches and the like. According to one particularly preferred embodiment, uncooked acid modified starches are particularly preferred. Suitable starches include practically all starches of plant origin including starches from corn, including waxy corn, wheat, potatoes, tapioca, rice, sago and sorghum with corn starch being preferred. Derivatized starches are also suitable for practice of the invention. Suitable starch derivatives include but are not limited to those such as starch ethers, starch esters, cross linked starches, oxidized starches and chlorinated starches.

The improved sizes further comprise a second component, which corresponds generally to the binder component of prior art materials comprising binder and a basic starch. The second component comprises starch and a reaction product of styrene and 1,3-butadiene wherein the starch is thinned and is characterized by an intrinsic viscosity of from about 0.07 dg/l to about 0.35 dg/l when measured in aqueous conditions at standard conditions (i.e. room temperature). The second component of the size compositions of the invention can comprise blends of starches characterized by an intrinsic viscosity of from about 0.07 dl/g and 0.35 dl/g with styrene/1,3-butadiene latices or alternatively can comprise reaction products of the thinned starches with styrene and 1,3-butadiene such as starch graft copolymers.

Starches suitable for use with the styrene/butadiene reaction product as a member of the second component of the invention include practically all starches of plant origin including starches from corn, including waxy corn, wheat, potatoes, tapioca, rice, sago and sorghum with corn starch being preferred. Derivatized starches are also suitable for practice of the invention. Suitable starch derivatives include but are not limited to those such as starch ethers, starch esters, cross linked starches, oxidized starches and chlorinated starches. Preferred starches are characterized by an intrinsic viscosity of from about 0.12 dl/g to about 0.25 dl/g and include a thinned lightly oxidized hydroxyethyl starch characterized by an intrinsic viscosity of about 0.23 dl/g available commercially as Pencote® (Penford Products Company, Cedar Rapids, Iowa). The starch should generally be sufficiently thinned by conventional techniques such as enzyme or acid thinning such that it is characterized by an intrinsic viscosity of less than about 0.35 dg/l because thicker starches are too viscous and are incapable of forming the size compositions of the invention. For example, the intrinsic viscosity of Pearl Starch (an unmodified, untied corn starch) is in the range of from about 0.80 to about 1.10 dl/g. At the same time, the starch should generally not be thinned to less than an intrinsic viscosity of about 0.07 dl/g as such starches tend to lose their film strength and may tend to lose their adhesive properties.

Suitable latices for use in starch, styrene/butadiene latex blends include commercially available styrene/butadiene rubber (SBR) blends. One preferred styrene/butadiene latex is Dow 620 latex but numerous other latices are useful according to the invention. In addition styrene/butadiene latices comprising additional copolymers as is well known in the art are also contemplated to be useful according to the invention.

The second component can comprise a blend of starch and a styrene/1,3-butadiene latex such as can be obtained commercially but is preferably a starch graft copolymer with styrene and 1,3-butadiene. Most preferred is a commercially available starch graft styrene/1,3-butadiene copolymer produced from the reaction product of styrene and 1,3-butadiene and a thinned lightly oxidized hydroxyethyl starch having a solids concentration of 30% by weight and characterized by an intrinsic viscosity of about 0.23 dl/g available commercially as Pencote® (Penford Products Company, Cedar Rapids, Iowa). The starch graft copolymer is characterized by a monomer to starch ratio of 42 parts monomer to 58 parts starch by weight with the monomer having a butadiene to styrene ratio of 42 parts butadiene to 58 parts styrene by weight and which was formerly available as Pentex™ and is currently available as PAF 3829-1 (Penford Products Company, Cedar Rapids, Iowa).

Starch graft copolymers of styrene and 1,3-butadiene can be produced according to methods such as those disclosed in Nguyen et al., U.S. Pat. No. 5,003,022 which discloses methods of producing styrene/butadiene containing starch graft copolymers. Suitable synthetic monomer (e.g. butadiene and styrene) to starch ratios for the binders range from about 30 parts monomer to 70 parts starch (by weight) to about 60 parts monomer to about 40 parts starch (by weight). Binder materials comprising higher ratios of monomer not only tend to be less cost effective, but may also be resistant to desizing due to coalescence of the monomer portion of the binder. Suitable monomer ratios in a styrene/butadiene copolymer range from about 30 parts butadiene to about 70 parts styrene (by weight) to the opposite ration of about 70 parts butadiene to about 30 parts styrene (by weight). In the practice of the present invention preferred copolymers may generally comprise higher ratios of butadiene to styrene because of the lesser cost of butadiene. One preferred binder material which can be used as the second component of the sizes is a styrene/1,3-butadiene starch graft copolymer produced from a highly thinned lightly oxidized hydroxyethyl starch characterized by an intrinsic viscosity of about 0.077 dl/g which binder which is produced generally according to U.S. Pat. No. 5,003,022. According to a preferred method the binder is produced according to the methods of U.S. Pat. No. 5,003,022 with the modifications that sodium bicarbonate buffer is added to the potassium persulfate initiated reaction mixture in order to maintain the pH at 4.0 or higher but alkali is then not added to the composition at a later time to raise its pH. The resulting reaction product is available commercially as Pengloss® (Penford Products Company, Cedar Rapids, Iowa).

In addition to including a first component comprising a starch and a second component comprising starch and a reaction product of styrene and 1,3-butadiene the warp yarn sizing materials of the invention further comprise water and other optional ingredients. Non-starch materials suitable for use as size components include polyvinyl alcohol which can be used either alone, or in combination with starches as size materials. Other ingredients making up the warp sizing composition include textile waxes such as hydrogenated tallow or hydrogenated vegetable oils, urea, surfactants, defoamers, salts, thickeners, lubricants, microbicides and the like. The exact selection of identities and amounts of materials varies according to the yarns to be sized and the fabric to be produced but is within the ordinary skill of those in the art.

Most preferred as a second component in this composition is the starch graft copolymer characterized by a monomer to starch ratio of 42 parts monomer to 58 parts starch by weight with the monomer having a butadiene to styrene ratio of 42 parts butadiene to 58 parts styrene by weight which is available as PAF 3829-1 (Penford Products Company, Cedar Rapids, Iowa). The size composition requires no polyvinyl alcohol binders or other additives although such additives may optionally be incorporated.

The amount of the second component which can be incorporated in the liquid size compositions of the invention is determined in part by the solids content of that component and the first component. For example, the starch graft copolymer available as PAF 3829-1 when used at a solids content of 30% typically comprises 4–10% and most preferably 6–8% of the size composition. At higher solids concentrations of 35% or even 40% lesser amounts of the second component may be required.

As one aspect of the invention a particularly preferred warp yarn size composition is provided which is characterized by long-term stability and represents an improvement over liquid emulsion size compositions which must be used soon after their preparation. Instead, a solid free flowing composition is provided with a water content of from about 8% to about 24% by weight which can be stored essentially indefinitely prior to blending with water and use. Specifically, a size is provided which has a solids content comprised of (i) approximately 90–96% uncooked acid modified starch as a first component, and (ii) approximately 4–10% of a second component comprising starch and a reaction product of styrene and 1,3-butadiene and wherein said starch is characterized by an intrinsic viscosity of from about 0.07 dl/g and about 0.35 dl/g.

The preferred solid free-flowing sizes of the invention are produced according to the method comprising blending a first component of about 30% solids with 96% to 90% by weight solids of starch with a second component comprising about 4% to about 10% by weight solids of PAF 3829-1 starch styrene/butadiene reaction product. Preferred starches for the first component comprise dry acid modified starches. A particularly preferred starch is an acid modified thin boil starch characterized by a 5 gram alkali fluidity which is available as Crown™ XH (Penford Products Company, Cedar Rapids, Iowa). Additives, including flow agents such as calcium silicates, biocides and other ingredients can be added to the free-flowing composition.

The components of the solid free flowing size compositions may be dry blended together using conventional batch-style blender devices. Alternatively, continuous mixing devices such as votaters, Turbulizers™ (Hosokawa Bepex Corp., Minneapolis Minn.) and the like may be used to blend the size ingredients to produce a solid free flowing composition. The resulting solid composition may optionally be subjected to drying to reduce the moisture content of the composition in order to reduce the risk of biological degradation. The solid size composition can also be transported or stored for future use in a size composition. When it is desired to use the size composition it may be blended with water and the starch component cooked out according to conventional methods known to the art. Typically, the size compositions are cooked at temperatures ranging from about 190° F. to about 210° F. and for time periods of about 30 minutes. The solids contents of the resulting size materials typically range from about 6 to about 16% by weight.

The warp yarn sizes produced according to the invention are useful with any sort of natural, synthetic or blended spun fibers. Such fibers include cotton, wool, silk, rayons, polyesters, nylons, viscose, acetate and like synthetic and natural fibers.

The following examples are provided in order to clearly illustrate the practice of the invention but are not to be considered to limit the scope of the invention. In the following examples 1 through 7, various types of warp yarns were sized with warp yarn sizing compositions made in accordance with the present invention. Following the sizing operation a weaving operation was carded out to determine the effect of the sizing on weaving as compared with conventional warp yarn sizing agents. Conventional size compositions typically comprise a basic size material such as modified or derivatized starch and/or polyvinyl alcohol; a binder such as a polyester resin, vinyl acetate, vinyl acetate copolymers, acrylic resin, polyvinyl alcohol or polyvinyl acetate; and a textile wax. One specific conventional size composition comprises a basic size comprising 50% ethylated starch and 50% polyvinyl alcohol; 20% (by weight based on basic size solids) of polyester resin liquid binder; and 7% (by weight based on basic size solids) of textile wax. In each of the examples, the sizing and weaving operations were carried out under standard current commercial conditions for that style of fabric at that mill location.

EXAMPLE 1

In this example, the warp yarn sizing formulation comprising starch and a styrene/butadiene starch graft copolymer as set out below was applied to a yarn which was Pima Cotton, (16/1, 1944 ends) to produce a Terry (pile) fabric. In this and the compositions of Examples 1 through 7, the starch corresponded to a basic size and the starch graft copolymer corresponded to a binder. Sizing and weaving with the composition of the invention reduced shedding at the slasher and during weaving by about 30 to 50% compared to conventional sizes.

Size formula;

| | |
|---|---|
| Water | 230 gal. |
| Starch (50 Fl, t.b., corn) | 75 lbs. |
| Starch graft copolymer (PAF 3829-1) (as is, 30% solids) | 45 lbs. |
| Textile Wax | 7 lbs. |
| Size add-on | 4.25% |
| Solids | 3.2% |

EXAMPLE 2

In this example, the warp yarn sizing formulation set out below according to the invention was applied to a yarn which was Cotton (80% reclaim cotton, 12/1 O.E.) to produce an Industrial fabric. Sizing and weaving with the yarn size composition of the invention almost eliminated shedding during the slashing and weaving steps by reducing such shedding by about 99% compared to conventional sizes.

Size formula;

| | |
|---|---|
| Water | 215 gal. |
| Starch (40 Fl, t.b., corn) | 200 lbs. |
| Starch graft copolymer (PAF 3829-1) (as is, 30% solids) | 44 lbs. |
| Textile Wax | 11 lbs. |
| Size add-on | 12.5% |
| Solids | 8.3% |

EXAMPLE 3

In this example, the warp yarn sizing formulation set out below according to the invention was applied to a yarn which was Cotton, (9/1 O.E., 4412 ends) to produce a Bottom Weight Apparel fabric. Sizing and weaving with the yarn size composition of the invention reduced shedding during the slashing and weaving steps by about 15% compared to conventional sizes.

Size formula;

| | |
|---|---|
| Water | 240 gal. |
| Hydroxyethyl Corn Starch (PG 330) | 200 lbs. |
| Starch graft copolymer (PAF 3829-1) (as is, 30% solids) | 45 lbs. |
| Textile Wax | 8 lbs. |
| Size add-on | 10.3% |
| Solids | 9.0% |

EXAMPLE 4

In this example, the warp yarn sizing formulation set out below according to the invention was applied to a yarn which was Cotton, (30/1 R.S., 4160 ends) to produce a Print Cloth fabric. Sizing with the yarn size composition of the invention reduced shedding during the slashing and weaving steps by about 50 to 70% compared to conventional sizes.

Size formula;

| | |
|---|---|
| Water | 205 gal. |
| Hydroxyethyl Corn Starch (PG 330) | 200 lbs. |
| Starch graft copolymer (PAF 3829-1) (as is, 30% solids) | 45 lbs. |
| Textile Wax | 16 lbs. |
| Size add-on | 14% |
| Solids | 10% |

EXAMPLE 5

In this example, the warp yarn sizing formulation set out below according to the invention was applied to a yarn which was Reclaim Cotton with up to 20% unknown waste fiber to produce a Industrial Wipe Cloth fabric. Sizing with the yarn size composition of the invention reduced shedding during the slashing and weaving steps by about 30 to 40% compared to conventional sizes.

Size formula;

| | |
|---|---|
| Water | 250 gal. |
| Starch (40 Fl, t.b., corn) | 300 lbs. |
| Starch graft copolymer (PAF 3829-1) (as is, 30% solids) | 90 lbs. |
| Textile Wax | 15 lbs. |
| Size add-on | 8.8% |
| Solids | 9.0% |

EXAMPLE 6

In this example, the warp yarn sizing formulation set out below according to the invention was applied to a yarn which was 50/50 polyester/cotton, (35/1, 6180 ends) to produce a Print Cloth fabric. Sizing with the warp yarn sizing of the invention reduced shedding during the slashing and weaving steps by about 15% compared to conventional sizes.

Size formula;

| | |
|---|---|
| Water | 1452 lbs. |
| Starch (40 Fl, t.b., corn) | 200 lbs. |
| Starch graft copolymer (PAF 3829-1) (as is, 30% starch) | 68 lbs. |
| Textile Wax | 16 lbs. |
| Size add-on | 15% |
| Solids | 11.2% |

EXAMPLE 7

In this example, the warp yarn sizing formulation set out below according to the invention was applied to a yarn which was Cotton, (6.3/1 O.E., 3530 ends) to produce a Denim fabric. Sizing with the warp yarn sizing of the invention reduced shedding during the slashing and weaving steps by about 70 to 90% compared to conventional sizes.

Size formula;

| | |
|---|---|
| Water | 250 lbs. |
| Starch (40 Fl, t.b., corn) | 250 lbs. |
| Starch graft copolymer (PAF 3829-1) (as is, 30% solids) | 60 lbs. |
| Textile Wax | 18 lbs. |
| Size add-on | 10% |
| Solids | 10.0% |

In the following examples 8 and 9 alternative methods for production of a particularly preferred solid free-flowing warp yarn sizing material are described. Examples 10 through 14 describe blending of that material in water to produce an emulsion which was then used to size various yarns under differing conditions.

EXAMPLE 8

In this example, a solid free-flowing warp yarn sizing formulation available commercially as Penflex™ 60 (Penford Products Co., Cedar Rapids, Iowa) was produced using the components listed below.

Size formula;

| | |
|---|---|
| Starch (Crown ™ starch XH) | 100 parts |
| Starch graft copolymer | 6 parts |

-continued

| | |
|---|---|
| (PAF 3829-1) (as is, 30% solids) | |
| Silicon dioxide (Pirosil PS-200) | 0.125 parts |
| Biocide (Kathon LX) | 0.006 parts |

The components listed above were blended in a dry starch batch style blender. Specifically, silicon dioxide flow agent (Pirosil PS-200) was added to an acid modified thin boil starch having a 5 gram alkali fluidity of 37–43 mL (Crown XH™, Penford Products Company, Cedar Rapids, Iowa) at 0.125% by weight of dry starch. Biocide (Kathon LX, Rohm & Haas, Philadephia, Pa.) was added to PAF 3829-1 starch styrene/butadiene reaction product (Penford Products Co., Cedar Rapids, Iowa ) at 0.1% of PAF 3829-1 total pounds and blended thoroughly.

The PAF 3829-1 grafted product/biocide mixture was added to the mixture at 6 parts d.s. PAF 3829-1 to 100 parts d.s. starch with an air pump attached with a spraying nozzle (preferably Spraying Systems 8002, Wheaton, Ill.) to assure uniform distribution. The nozzle was aligned on the side of the blender where the starch is rising in order to avoid accumulation of the PAF 3829-1 grafted product component on the blender blades. The composite product was then allowed to blend for 10–15 minutes and the resulting material was milled through a 0.25 inch screen in order to break up any clumps and improve solubility of the blend.

The resulting product, after milling, has a moisture content of from 16 to about 20% and is solid and has suitable flowability properties. While the moisture content can be as high as about 24% before flowability properties are impaired, elevated moisture content less than 24% can possibly lead to bacteriological contamination and spoilage. Accordingly, lower moisture contents are preferred and can be provided by conventional solids handling and drying means. Drying the material can also allow reduction in the mounts of bactericide and flow agent typically incorporated therein.

The resulting product could then optionally be subjected to drying to reduce the moisture content prior to transport or storage for future use in a size composition. When the dry free flowing size composition is to be used to produce a liquid size it may simply be blended with water according to conventional means to produce a liquid size. Solids content may then be adjusted as desired.

EXAMPLE 9

In this example, an alternative means for producing the preferred solid free-flowing size material of the invention is practiced. Specifically, the component materials are dry blended in a continuous mixing device known as a Turbulizer (Model TCJS-8 available from Hosokawa Bepex Corp., Minneapolis, Minn.). According to the method of use, an acid modified thin boil starch is used having a 5 gram alkali fluidity of 37–43 mL (Crown XH™, Penford Products Company, Cedar Rapids, Iowa). The starch is a white, odorless and free flowing powder having a particle size of 50% plus 40 mesh and 95% plus 100 mesh with a moisture content of 10.40%. The starch optionally comprises a small amount of silicon dioxide as a flow agent. Also used is a starch styrene/butadiene reaction product (PAF 3829-1, Penford Products Company) which is a white liquid and has a solids content of about 30% by weight.

The Turbulizer mixing device was used with a rotor speed of 1500 rpm and a paddle setting of four pitched forward and six flat in each row. Runs mixing materials at rates of 300 pounds/hour of dry starch (including the silicon dioxide flow agent) and 66 pounds/hour of copolymer liquid gave excellent results as did runs with feed rates doubled to 600 pounds/hour of dry starch and 132 pounds/hour of copolymer liquid. In additional runs the copolymer liquid was added at a ratio of 18% by weight of the total mixture (instead of 18 pounds for every pound of dry starch) and the device performed well. Overall, the device did an excellent job of producing a homogeneous mixture on a continuous basis and produced product with moisture levels ranging from 20.5% to 22.7%.

The resulting product could then be subjected to drying to reduce the moisture content or transported or stored for future use in a size composition.

EXAMPLE 10

In this example, a warp yarn sizing formulation produced according to the general method of Example 8 was blended with water and cooked up according to standard methods in amounts as set out below and was applied to a yarn which was Cotton, (80% reclaimed cotton, 12/1 O.E., 1396 ends) to produce an industrial fabric. Sizing with the warp yarn sizing of the invention resulted in reduced shedding during the slashing and weaving steps versus conventional sizes. In addition, fabric produced from the sized yarn exhibited desize properties comparable to those of products sized with conventional sizes.

Size formula;

| | |
|---|---|
| Water | 225 gal. |
| Size (Penflex ™ 60) | 250 lbs. |
| Size add-on | 10.3% |

EXAMPLE 11

In this example, the warp yarn sizing formulation of Example 8 was cooked up in water in amounts as set out below and was applied to a yarn which was 50/50 Polyester/Cotton, 25/1 O.E., 5232 ends to produce a sheeting. Sizing with the warp yarn sizing of the invention resulted in reduced shedding during the slashing and weaving steps versus conventional sizes. In addition, fabric produced from the sized yarn exhibited desize properties comparable to those of products sized with conventional sizes.

Size formula;

| | |
|---|---|
| Water | 445 gal. |
| Size (Penflex ™ 60) | 500 lbs. |
| Textile Wax | 15 lbs. |
| Size add-on | 11% |

EXAMPLE 12

In this example, the warp yarn sizing formulation of Example 8 was cooked up in water in amounts as set out below and was applied to a cotton yarn which was 30/1 R.S., 3760 ends to produce a print cloth. Sizing with the warp yarn sizing of the invention resulted in reduced shedding during the slashing and weaving steps versus conventional sizes. In addition, fabric produced from the sized yarn exhibited desize properties comparable to those of products sized with conventional sizes.

Size formula;

| | |
|---|---|
| Water | 185 gal. |
| Size (Penflex ™ 60) | 200 lbs. |
| Textile Wax | 10 lbs. |
| Size add-on | 11.5% |

EXAMPLE 13

In this example, the warp yarn sizing formulation of Example 8 was cooked up in water in amounts as set out below and was applied to a 50/50 polyester/cotton yarn which was 30/1 O.E., 4020 ends to produce a print cloth. Sizing with the warp yarn sizing of the invention resulted in reduced shedding during the slashing and weaving steps versus conventional sizes. In addition, fabric produced from the sized yarn exhibited desize properties comparable to those of products sized with conventional sizes.

Size formula;

| | |
|---|---|
| Water | 220 gal. |
| Size (Penflex ™ 60) | 400 lbs. |
| Textile Wax | 15 lbs. |
| Size add-on | 11.75% |

EXAMPLE 14

In this example, the warp yarn sizing formulation of Example 8 was cooked up in water in amounts as set out below and was applied to a 65/35 polyester/cotton yarn which was 19/1 to produce an apparel fabric. Sizing with the warp yarn sizing of the invention resulted in reduced shedding during the slashing and weaving steps versus conventional sizes. In addition, fabric produced from the sized yarn exhibited desize properties comparable to those of products sized with conventional sizes.

Size formula;

| | |
|---|---|
| Water | 200 gal. |
| Size (Penflex ™ 60) | 300 lbs. |
| Textile Wax | 12 lbs. |
| Size add-on | 9.75% |

As can be seen above, the warp yarn sizing compositions of the invention can comprise different basic size materials and other ingredients, and can be applied to a wide variety of fabric materials at varying solids concentrations and add-on amounts. It is anticipated that numerous variations and modifications of the embodiments described above will occur to those of ordinary skill in the art when apprised of the teachings of the present specification. Accordingly, only such limitations as appear in the appended claims should be placed thereon.

What is claimed is:

1. A method of preparing a sized warp yarn said method comprising the steps of:

(a) preparing a warp yarn sizing composition comprising (i) a first component which is a starch material, and (ii) a second component which comprises starch and a reaction product of styrene and 1,3-butadiene wherein said starch component of said second component is characterized by an intrinsic viscosity measured at 25° C. with the solute being water of from about 0.07 dl/g to about 0.35 dl/g; and (b) slashing warp yarn with the sizing composition of step (a).

2. The method of claim 1 wherein said warp yarn sizing composition comprises a textile wax.

3. The method of claim 1 wherein said first component comprises starch which is characterized by an intrinsic viscosity measured at 25° C. with the solute being water of about 0.12 dl/g to about 0.25 dl/g.

4. The method of claim 1 wherein said second component comprises a styrene/1,3-butadiene starch graft copolymer.

5. The method of claim 1 wherein said second component comprises a blend of starch and a styrene/1,3-butadiene latex.

6. The method of claim 1 wherein said first component comprises an uncooked acid modified starch.

7. The method of claim 6 wherein said size composition comprises from 90–94% by weight solids of said first component comprising uncooked acid modified starch and from 6–10% by weight solids of said second component comprising starch and a reaction product of styrene and 1,3-butadiene wherein said starch is characterized by an intrinsic viscosity measured at 25° C. with the solute being water of from about 0.7 dl/g and about 0.35 dl/g.

8. A warp yarn sizing composition comprising a (i) first component which is a starch material, (ii) a second component which comprises starch and a reaction product of styrene and 1,3-butadiene, and (iii) a textile wax, wherein said starch component of said second component is characterized by an intrinsic viscosity measured at 25° C. with the solute being water of about 0.07 dl/g to about 0.35 dl/g.

9. The warp yarn sizing composition of claim 8 wherein said second component comprises a starch which is characterized by an intrinsic viscosity measured at 25° C. with the solute being water of about 0.12 dl/g to about 0.25 dl/g.

10. The warp yarn sizing composition of claim 8 wherein said second component comprises a styrene/1,3-butadiene starch graft copolymer.

11. The warp yarn sizing composition of claim 8 wherein said second component comprises a blend of starch and a styrene/1,3-butadiene latex.

12. The warp yarn sizing composition of claim 8 wherein said first component comprises an uncooked acid modified starch.

13. The warp yarn sizing composition of claim 12 which has a solids content comprising from 90–94% by weight of said first component and from 6–10% by weight of said second component.

14. The warp yarn sizing composition of claim 8 which is from about 8 to about 22 percent water by weight.

15. A sized warp yarn prepared according to the method of claim 1.

16. The sized warp yarn according to claim 15 wherein the warp yarn sizing binder comprises a styrene/1,3-butadiene starch graft copolymer.

17. A sized cloth comprising a sized warp yarn prepared according to the method of claim 1.

18. The sized cloth according to claim 17 wherein the warp yarn sizing binder comprises a starch styrene/1,3-butadiene graft copolymer.

* * * * *

UNITED STATES PATENT AND TRADEMARK OFFICE

CERTIFICATE OF CORRECTION

PATENT NO. : 5,707,720

DATED : January 13, 1998

INVENTOR(S) : Charles J. Fox

It is certified that error appears in the above-identified patent and that said Letters Patent is hereby corrected as shown below:

Col. 3, line 6: After "...up to the", delete "right" and insert -- light --.

Col. 4, line 34: After "...available as", delete "Pentex" and insert -- Penflex --.

Col. 6, line 25: After "...operation was", delete "carded" and insert -- carried --.

Signed and Sealed this

Thirtieth Day of May, 2000

*Attest:*

*Attesting Officer*

Q. TODD DICKINSON

*Director of Patents and Trademarks*